US007338358B2

(12) United States Patent
Kim et al.

(10) Patent No.: US 7,338,358 B2
(45) Date of Patent: Mar. 4, 2008

(54) APPARATUS FOR AIR PURIFYING AND VENTILATING

(75) Inventors: Jeong Yong Kim, Seoul (KR); Gi Seop Lee, Incheon (KR); Kwan Ho Yum, Seoul (KR)

(73) Assignee: LG Electronics Inc., Seoul (KR)

( * ) Notice: Subject to any disclaimer, the term of this patent is extended or adjusted under 35 U.S.C. 154(b) by 207 days.

(21) Appl. No.: 10/911,497

(22) Filed: Aug. 5, 2004

(65) Prior Publication Data

US 2005/0164625 A1 Jul. 28, 2005

(30) Foreign Application Priority Data

Jan. 28, 2004 (KR) ..... 10-2004-0005434

(51) Int. Cl.
*F24F 7/007* (2006.01)

(52) U.S. Cl. ..... 454/252; 454/257; 454/261

(58) Field of Classification Search ..... 454/252, 454/238, 237, 251
See application file for complete search history.

(56) References Cited

U.S. PATENT DOCUMENTS 4,537,035 A * 8/1985 Stiles ..... 62/89
5,290,200 A * 3/1994 Kiser ..... 454/229
5,564,626 A * 10/1996 Kettler et al. ..... 236/49.3
5,590,830 A 1/1997 Kettler et al.
5,597,354 A * 1/1997 Janu et al. ..... 454/229
5,707,005 A 1/1998 Kettler et al.
6,149,698 A 11/2000 Uehara
6,328,776 B1 * 12/2001 Shanks et al. ..... 55/385.2
6,398,118 B1 * 6/2002 Rosen et al. ..... 236/49.3
6,743,091 B2 * 6/2004 Meneely, Jr. ..... 454/343
6,790,136 B2 * 9/2004 Sharp et al. ..... 454/229

FOREIGN PATENT DOCUMENTS

CA 1320047 7/1993

(Continued)

OTHER PUBLICATIONS

U.S. Appl. No. 10/911,513 to Kim et al.

(Continued)

*Primary Examiner*—Derek S. Boles
(74) *Attorney, Agent, or Firm*—Greenblum & Bernstein, P.L.C.

(57) ABSTRACT

Disclosed is a combination air purifier and ventilator. The air purifier in accordance with the present invention includes a case being provided on a ceiling or a wall and having a fan therein, a first passage communicating with an outside, an inside of the case and an room, having an air purifying member being provided between the inside of the case and the room, and guiding the external air into the room, a second passage communicating with the room, the fan, and the outside, and guiding the room air to the outside, and a damper provided in the case for isolating the first passage from the second passage for supplying the external air into the room and discharging the room air to the outside, or communicating with the fist and second passages to guide the room air drawn into the second passage back into the room after passing through the air purifying member.

15 Claims, 4 Drawing Sheets

FOREIGN PATENT DOCUMENTS

| | | |
|---|---|---|
| EP | 0838639 | 4/1998 |
| EP | 1132690 | 9/2001 |
| JP | 5-106884 | 4/1993 |
| JP | 6-034175 | 2/1994 |
| JP | 9-253435 | 9/1997 |
| JP | 2002-206778 | 7/2002 |

OTHER PUBLICATIONS

English Language Abstract of JP 5-106884.
English Language Abstract of JP 6-034175.
English language Abstract of JP 9-253435.
English language Abstract of JP 2002-206778.

* cited by examiner

APPARATUS FOR AIR PURIFYING AND VENTILATING

CROSS-REFERENCE TO RELATED APPLICATIONS

This application claims the benefit of Korean Application No. P2004-05434, filed on Jan. 28, 2004, which is hereby incorporated by reference as if fully set forth herein.

BACKGROUND OF THE INVENTION

1. Field of the Invention

The present invention relates to an air purifier, and more particularly, to an air purifier with an air purifier with a function of ventilating a room.

2. Discussion of the Related Art

An air purifier is an apparatus for drawing room air, removing alien substance, and blowing purified air back to a room. Since air pollution becomes severe and a standard of living is raised, the air purifier has been widespread. In general, the air purifier is provided in a single package form, and a user can use the air purifier being provided on a floor of the room.

The air purifier provided on a floor has a problem of disabling effective removal of dust floating in air. The air purifier removes dust by drawing only room air, and supply back to the room. As operation time of the air purifier passes, $O_2$ content is lowered and $CO_2$ content is increased. Therefore, it is troublesome to regularly ventilate the room air by opening the window, periodically.

For automatically ventilating the room air, there is a problem of spending high installation expense and maintain expense because an independent ventilation apparatus is needed in addition to the air purifier.

Meanwhile, the air purifier provided on the floor has another problem of easily being turned over by children, or causing a mechanical trouble because the children can easily approach thereto.

SUMMARY OF THE INVENTION

Accordingly, the present invention is directed to a combination air purifier and ventilator that substantially obviates one or more problems due to limitations and disadvantages of the related art.

An object of the present invention is to provide a combination air purifier and ventilator for not only effectively removing dust floating in air, but also ventilating room air.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a combination air purifier and ventilator includes a case being provided on a ceiling or a wall and having a fan therein, a first passage communicating with an outside of room, an inside of the case, and a room, having an air purifying member being provided between the inside of the case and the room, and guiding external air into a room, a second passage communicating with the room, the fan, and the outside of room, and guiding the room air to the outside, and a damper provided in the case for isolating the first passage from the second passage for supplying the external air into the room and discharging the room air to the outside, or communicating with the fist and second passages to guide the room air drawn into the second passage back into the room after passing through the air purifying member.

It is desirable that the first passage is formed in a bent form in the case such that an air flow direction of air drawn into the case and that of the air supplied into the room are different. It is also desirable that the second passage is formed in a bent form in the case such that an air flow direction of air drawn into the case and that of the air supplied into the room are different. It is desirable that the fan draws air in an axis direction and discharges in a radius direction. It is desirable that the case includes an inlet and outlet for communicating the case with the room, and a supply duct and a return duct for communicating the case with the outside.

In another aspect of the present invention, a combination air purifier and ventilator includes a case provided on a ceiling or a wall and having an inlet and outlet, a fan provided in the case for drawing room air, a supply duct having a first end being coupled with the case and a second end being coupled with outside for guiding external air into the case, a return duct having a first end being coupled with the case and a second end being coupled with an outside and guiding room air to the outside, an air purifying member provided in the case for purifying the air passed through the fan or the supply duct and supplied into the room, and a damper provided in the case for communicating the inlet with the return duct and communicating the outlet with the supply duct according to an operation mode, or communicating the inlet with the outlet.

An operation mode includes an air purifying mode wherein the damper is opened, external air is drawn through the inlet, and the room air passed through the fan is guided to the outlet, and a ventilating mode wherein the damper is closed, the room air drawn through the inlet and passed through the fan is guided to the return duct, and the external air guided to the supply duct is guided to the outlet.

It is desirable that a sensor provided at the case for measuring the room air content. It is desirable that the damper is automatically opened and closed according to the air content measured by the sensor. It is desirable that the sensor comprises a $CO_2$ measuring sensor. It is desirable that the air purifying member comprises at least one of a filter, a UV (ultraviolet) lamp, a terpene generator, an $O_2$ generator, and an aromatic machine.

It is desirable that the combination air purifier and ventilator further includes a valve provided at least one of the supply duct or the return duct for opening and closing the supply duct and the return duct.

It is desirable that the combination air purifier and ventilator further includes an electric heat exchanger for exchanging heat between the supply duct and the return duct such that the air flowing in the supply duct and the return duct indirectly exchanges heat.

It is desirable that the combination air purifier and ventilator further includes at least one hollow tube being formed in at least one of the supply duct and the return duct and communicating with the room.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
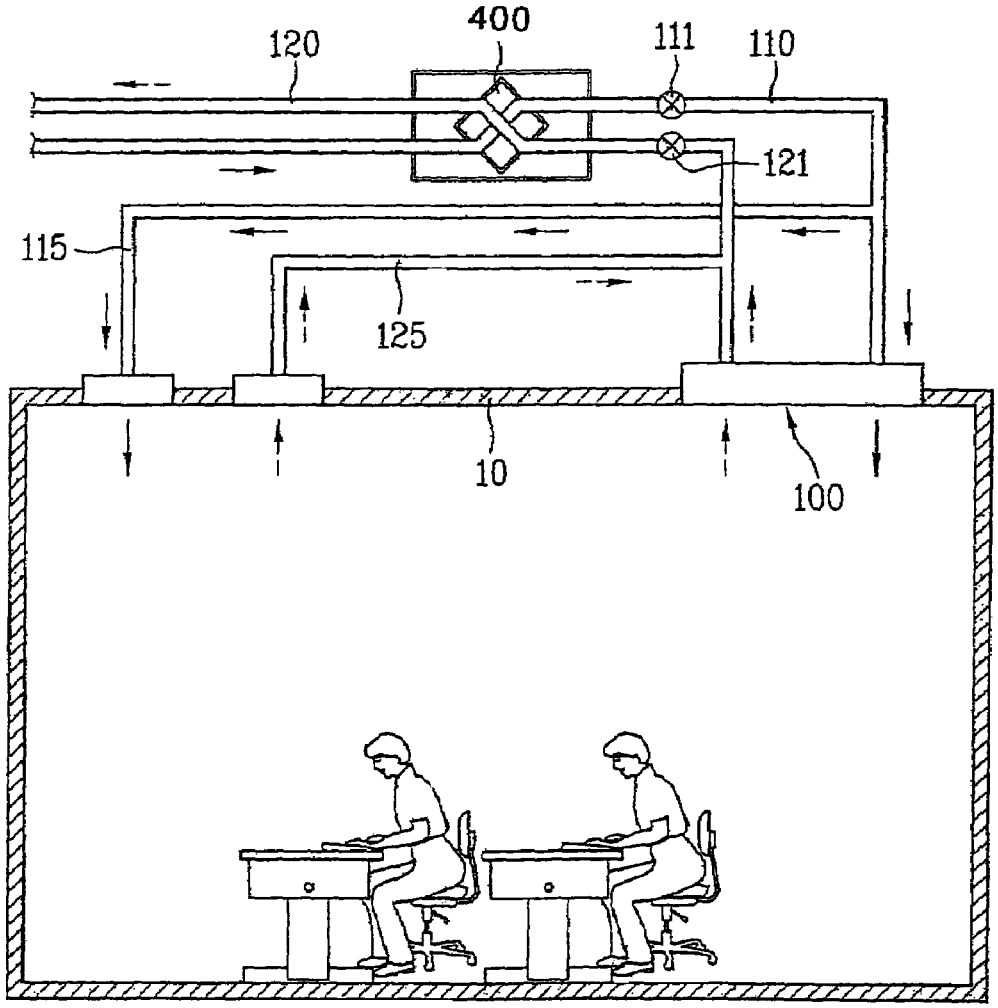
FIG. 1 illustrates a diagram of an air purifier in accordance with the present invention, schematically.

Referring to FIG. 1 and FIG. 2, the air purifier 100 is provided not in a package form, but in built in form. In other words, contrary to a conventional air purifier having a case 101 provided in a room, the case 101 of the air purifier 100 in accordance with the present invention is provided on a ceiling or on a wall, although not illustrated.

A fan 150 is provided in the case 101 for blowing air in the case 101. It is desirable that the fan 150 draws in air in an axis direction and discharges in a radius direction. The fan 150 includes a motor 151 and a fan 152. The fan 152 draws in air in an axis direction and then discharges in the radius direction.

In the abovementioned structure, an air flow direction in the case 101 is changed. Accordingly, arrangement of various parts to be provided according to the air flow direction needs to be changed. Therefore, the case 101 can be compact by reducing height and thickness of the case 101.

At least one side of the case 101 is abutted on the room, and an inlet 130 and an outlet 140 are provided, respectively, on the side abutted on the room among the sides of the case 101 for communicating with the room. The inlet 130 and the outlet 140 are separated from the case 101 by a partition 105.

On a side of the case 101, a supply duct 110 and a return duct 120 are provided, and the supply duct 110 and the return duct 120 communicate the case with the room.

Figure 2A:
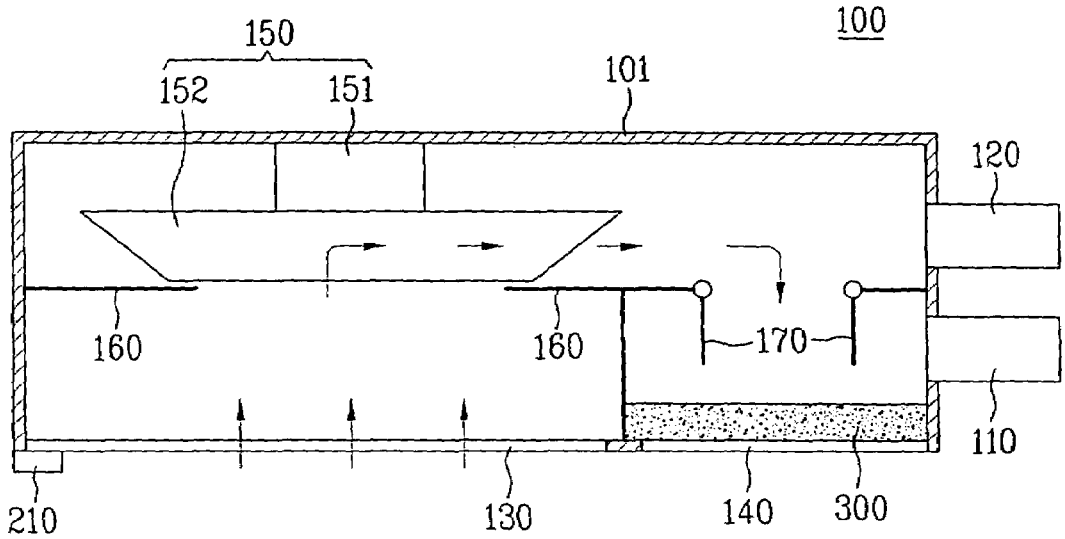
FIGS. 2A and 2B illustrate a diagram of an air purifier on air purifying mode and ventilating mode, respectively, in accordance with a first preferred embodiment and second preferred embodiment of the present invention.

For purifying the air supplied into the room, an air purifier 300 is provided on a first passage between the fan 150 and the room. In more detail, the air purifier 300 is provided in a space between the supply duct 110 and the return duct 140. In this case, the air purifier 300, as illustrated in FIG. 2A, is provided to cover the outlet 140.

Meanwhile, the air purifier 100 in accordance with the present invention includes two passages passing through the case 101. One of the passage is a first passage for drawing external air into the case 101, purifying the air, and supplying the air to the room, and another one is a second passage for passing the air through the case 101, and discharging the air to an outside. As abovementioned, by providing the first and second passages, the air purifier 100 of the present invention not only purifies the room air, but also ventilates the room with external air. Hereinafter, the structure of the firs passage and second passage will be described in more detail referring FIG. 2A.

Figure 2B:
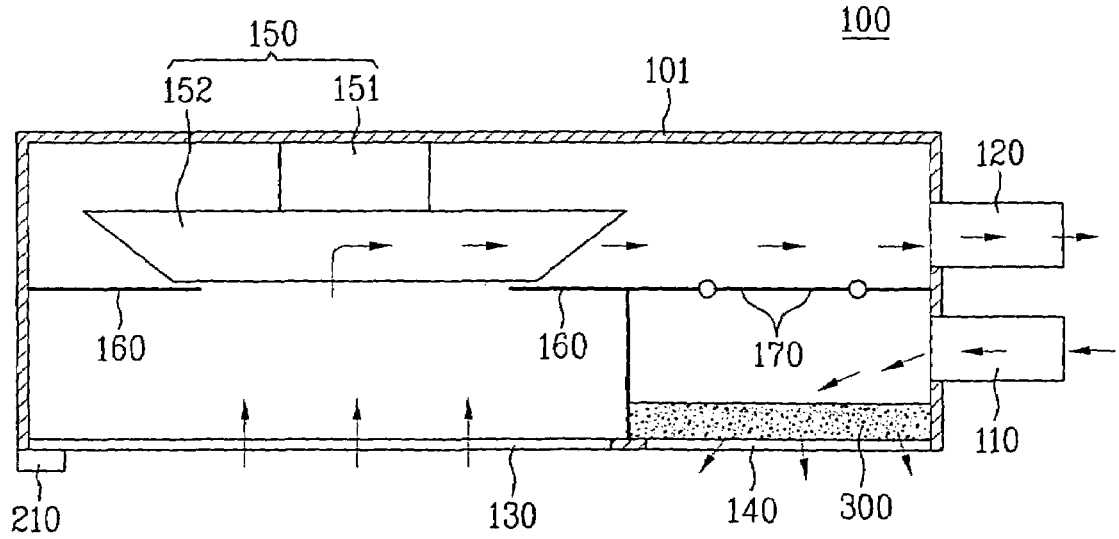

First, the first passage communicates with the outside, inside of the case, and the room. The first passage, for example, includes the supply duct 110, the case 101, and the outlet 140 as illustrated in FIG. 2B.

In this case, an end of the supply duct 110 is coupled with a side abutted on a side of the case 101, particularly to a side having the outlet 140, and communicates the outside with the inside of the case 101. Although not illustrated, in the supply duct 110 provided as abovementioned, a fan is provided for sending the external air toward the case 101.

When the first passage is provided as abovementioned, the first passage is formed in a bent form in the case 101. In this structure, the flow direction of the air flowed into the case 101 is different from the flow direction of the air supplied into the room. Accordingly, arrangement of various parts to be provided according to the air flow direction in the case 101 can be changed so as to make the case 101 compact by reducing the height and thickness of the case 101.

By the air purifier 300 provided as abovementioned, all alien substances in the external air flowed into the case 101 through the supply duct 110 is purified. Therefore, only purified air is supplied into the room.

Next, the second passage communicates with the room, the fan 150, and the outside. The second passage, for example, includes the inlet 130, the fan 150, and the return duct 120 as illustrated in FIG. 2.

The second passage is a passage wherein the room air is guided to the return duct 120 through the inlet 130 and the fan 150, and discharged to the outside. An air guide 160 is provided for guiding the air form the inlet 130 to the fan 150.

The inlet 130 communicates with the room, and can be provided in line with the outlet 140. In this case, it is desirable that the inlet 130 and the outlet 140 are separated by the partition 105 provided in the case 101.

The return duct 120 communicates with the fan 150 and the inlet 130. Although not illustrate, in the return duct 120 provided as abovementioned, the fan is provided for supplying the room air drawn in to the inside of the case 101 through the inlet 130.

The return duct 120 is provided on a side abutted on the side the case 101, the inlet 130 and the outlet 140 are provided thereon. The return duct 120 is provided to draw the air passed trough the inlet 130 and the fan 150.

As mentioned above, when the return duct is coupled with the case 101, the room air drawn into the case 101 through the inlet 130 by the fan 150 is discharged to the outside through the return duct 120. In this case, the air drawn into the case 101 through the inlet 130 and the air discharged to the room from the case 101 are divided by the partition 105 without mixing each other.

When the second passage is provided as abovementioned, the second passage is formed in a bent form. The flow direction of the air flowed into the case 101 is different from the flow direction of the air supplied into the room. Accordingly, as aforementioned, because arrangement of various parts to be provided according to the air flow direction can be changed, the case 101 can be compact by reducing height and thickness of the case 101.

The case 101 having the fan 150 as abovementioned, when the first and second passages are provided at the air purifier 100, the external air is purified by the firs passage and supplied into the room, and polluted room air is discharged to the outside through second passage. Accordingly, the air purifier 100 in accordance with the present invention can perform not only air purifying function, but also ventilating function.

Meanwhile, the air purifier 100 in accordance with the present invention further includes a damper 170 for controlling flow passages of the room air flowed into the case 101 or external air. The damper 170 is provided in the case 101, and performs a role of selectively communicating or blocking the first passage or the second passage.

In more detail, the damper 170 isolates the first passage from the second passage for discharging the room air to the outside and guiding the external air to the room, or performs a role of communicating the first passage with the second passage such that the room air drawn into the second passage is flowed into the room through the fan 150. Hereinafter, the damper 170 performing the role is described in more detail.

First, the damper 170 is provided at a part of the first passage, the part abutted with the second passage, for opening or closing a part of the second passage. In other words, as illustrated in FIG. 2A, the damper 170 is provided at the case 101 coupling the partition 105 with the supply duct.

In the structure, when the damper 170 is opened, the inlet 130 communicates with the outlet 140, thereby the first passage communicates with the second passage as illustrated in FIG. 2A.

In this case, the air flowed into the case 101 through the inlet 130 is guided to the fan 150 by the air guide 16, and supplied back into the room. Accordingly, the room air is purified by the air purifier 100 in accordance with the present invention, and supplied back into the room.

In this instance, the external air is drawn into the case 101 through the supply duct 110 and discharged through the return duct 120. Accordingly, it is desirable that the fans provided in the supply duct 110 and the return duct 120, respectively, are stopped.

Contrary to above, when the damper is closed as illustrated in FIG. 2B, the inlet is isolated from the outlet, therefore, the first passage is isolated from the second passage.

In this case, the room air drawn into the case 101 through the inlet 130 is guided to the return duct 120, and external air drawn into the case 101 through the supply duct 110 is passed through the fan 150, purified, and supplied into the room.

In this instance, it is desirable that the fan provided respectively in the supply duct 110 and the return duct 120 such that the air is well flowed through the supply duct 110 and the return duct 120.

In the mean time, at least one of the supply duct 110 and the return duct 120, as illustrated in FIG. 1, valves 111 and 121 opening or closing the supply duct 110 or the return duct 120 are provided. In this case, flowing the air through the supply duct 110 and the return duct 120 is permitted or prevented by opening or closing the valves 11 and 121.

When the damper 170 is provided at the air purifier 100, without introducing the external air, only the room air is purified, and supplied into the room, or the air purified ventilating the room is supplied back into the room, selectively. Therefore, the air purifier 100 is effectively used.

Secondly, the air purifier in accordance with the present invention will be described. One side of the case 101 is abutted on the room, and of the sides of the case 101, on the side abutted on the room, the inlet 130 and the outlet 140 are communicated with the room, respectively. The inlet 130 is isolated from the outlet 140 by the partition 105.

In the case, in the case 101, the fan 150 is provided for drawing the room air into the case 101 and discharging the drawn air to the outlet 140. It is desirable that the fan 150 draws air in the axis direction and discharges in the radius direction. The fan 150 includes the motor 151 and the fan 152, and it is desirable that the fan 152 draws air in the axis direction and discharges in the radius direction.

In the abovementioned structure, an air flow direction in the case 101 is changed. Accordingly, arrangement of various parts to be provided according to the air flow direction can be changed. Therefore, the case 101 can be compact by reducing height and thickness of the case 101.

Meanwhile, the ducts 110 and 120 are coupled with the case 101 and ventilate the room air. The ducts 110 and 120 include the supply duct 110 and the return duct 120.

A first side of the supply duct 110 is coupled with the case 101, and another side thereof is coupled with the outside. The external air is guided into the case by the supply duct 110, and into the room through the outlet 140.

A first side of the return duct 120 is coupled with the case 101, and a second side thereof is coupled with the outside, thereby the room air drawn in the case 101 is guided to the outside.

In more detail, the location of the supply duct 110 and the return duct 120 in contact with the case 101 is coupled with a side of the case 101, particularly to the side abutted on the outlet 140.

In the supply duct 110 and the return duct 120, valves 111 and 121 are provided for opening and closing the ducts 110 and 120, respectively. Accordingly, the ducts 110 and 120 are opened or closed by the valves 111 and 121, respectively. A fan is provided in the ducts 110 and 120, respectively.

Meanwhile, the air purifier in accordance with the present invention includes the damper 170. The damper 170 communicates the outlet 140 with the return duct, or communicates the inlet with the outlet 140, communicating the inlet 130 with the supply duct 120 according to the operation mode at the case 101.

The operation mode includes an air purifying mode opening the damper 170 and a ventilating mode closing the ventilating mode.

Each operation mode will be described in more detail. In the air purifying mode, the damper 170 is opened and the room air passed through the inlet 130 and the fan 150 is guided. The valves 111 and 121 close the supply duct 110 and the return duct 120. In the ventilating mode, the damper 170 is closed, the room air passed through the inlet 130 and the fan 150 is guided to the supply duct 102, and the external air guided into the case 101 by the supply duct 110 is guided to the outlet 140. In the ventilating mode, the valves 111 and 121 are opened and the fans provided in the supply duct 110 and the return duct 120 are operated.

In more detail, the damper 170 is provided between the outlet 140 and the fan 150, on a side of the case 101 in contact with the partition 105, the supply duct, and the return duct. The portion of the damper 170 in contact with the supply duct and the return duct is divided respectively. Meanwhile, in the case 101, an air guide 160 is provided. The air guide 160 is provided between the inlet 130 and the fan 150, and guides the room air to be flown in the case 101 more smoothly by the fan 150, the room air drawn by the fan 150.

In the mean time, an air purifying member 300 is provided for purifying the air supplied into the room. The air purifying member 300 is described in more detail referring to FIGS.

3, 4, and 5. The air purifying member 300 is provided in the case 101, particularly between the fan 150 and the outlet 140. In this case, the air purifying member 300 is provided to cover the outlet 140.

When the air purifying member 300 is provided as abovementioned, all alien substances are purified by the air purifying member 300, the alien substances included in the room air drawn by the fan and discharged from the outlet 140 and in the external air drawn into the case 101 through the supply duct 110.

In the case 101, a sensor 210 is provided for measuring room air component. The sensor 210 is electrically coupled with a controller (not shown) and sends measured result of the room air component to the controller. The controller controls the operation mode by comparing the measured result to with a predetermined standard. Therefore, the operation mode is automatically changed to the ventilating mode or the air purifying mode by the controller.

The sensor 210 is attached to a side of the case 101 abutted on the room, for example, around the inlet 130. The sensor 210, in more detail, includes a carbon dioxide measuring sensor for measuring carbon dioxide content in the room air. In the case, the sensor is widely used for measuring the carbon dioxide content in the air, thus the construction is omitted.

Referring to FIG. 2A and FIG. 2B, operation of the air purifier with ventilating function is described. In FIG. 2A, the air purifier in the air purifying mode is illustrated, and in FIG. 2B, the air purifier in the ventilating mode is illustrated.

The sensor 210 measures the room air component and send to the controller. The controller determined operation mode according to the room air component.

In the air purifying mode, the room air flows in an arrow direction illustrated in FIG. 2A. The room air is drawn into the case 101 through the inlet 130 by the fan 150. In this instance, the air guide 160 smoothly guides the drawn room air to the fan 150.

The room air is discharged in the radius direction from the fan 150 and moved to the damper 170. The opened damper 170 guides the room air passed through the fan 150 to the outlet 140. Before the external air is discharged into the room, alien substances in the external air is purified at the air purifying member, then the external air is passed through the outlet 140 and discharged into the room.

In this instance, it is desirable that all the fans provided in the supply duct 110 and the return duct 120 are operated such that the air is smoothly flowed through the supply duct 110 and the return duct 120.

When the air purifier 100 is operated, the partition 105 prevents the air drawn through the inlet 130 from being mixed with the air discharged through the outlet 140.

Meanwhile, at least one of the supply duct 110 and the return duct 120 includes valves 111 and 121 for opening or closing the supply duct 110 or the return duct 120 as illustrated in FIG. 1. In this case, the air flowing through the supply duct 110 and the return duct 120 is permitted or prevented by opening or closing the valves 111 and 121.

The mode can be changed manually by the user into the air purifying mode and the ventilating mode, or automatically. For example, when the sensor displays the measured the carbon dioxide content in the room air, referring to the displayed data, the operation of the damper 170 and the valves 111 and 121 can be changed. On the other hand, when the operation mode is automatically changed, based on the data measured at the sensor 210, the controller changes the operation of the damper 170 and the valves 111 and 121.

When damper 170 is provided at the air purifier, only the room air is purified and supplied into the room without drawing external air, supplying the purified air to the room in synchronism with ventilating the room can be selectively performed.

Figure 3:
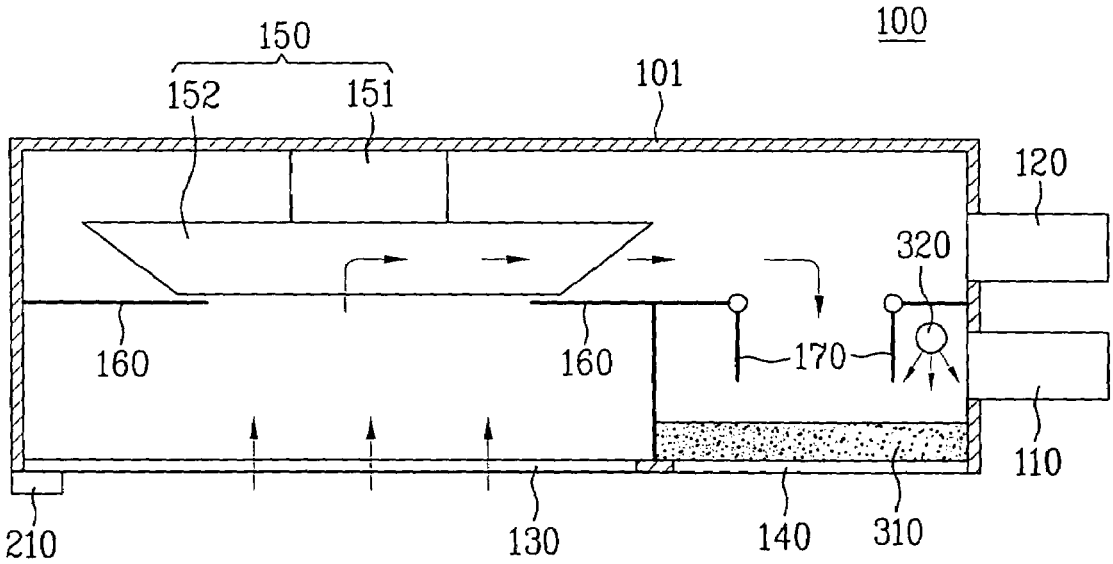
FIGS. 3, 4, and 5 illustrate a diagram showing an air purifier in accordance with a third to fifth preferred embodiments of the present invention.
Figure 4:
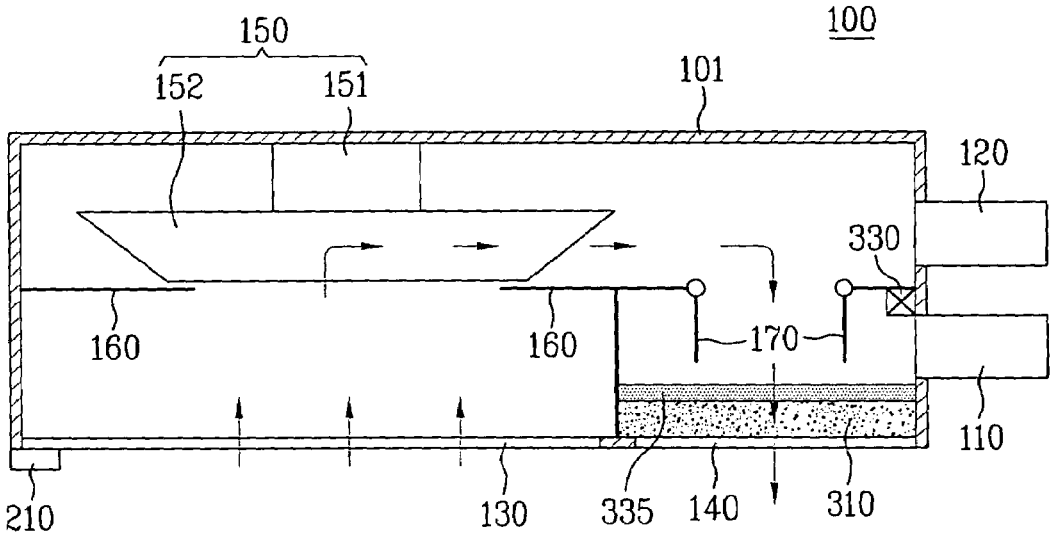
Figure 5:
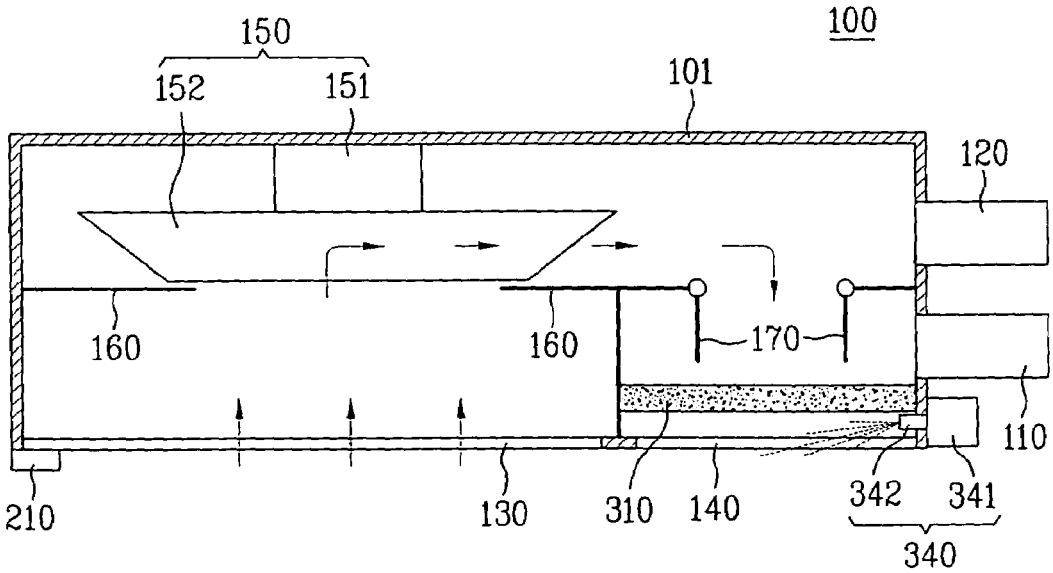

Referring to FIGS. 3, 4, and 5, the air purifier 300 is further provided at the air purifier 100. The air purifying member 300 is provided at the case 101 and removes germs and bacteria in the air by purifying the air supplied into the room. The air purifying member 300 includes at least one of a filter 310, a UV (ultraviolet) lamp 320, an ion generator 330, and a terpene generator 340.

As illustrated in FIG. 3, the UV lamp 320 is provided at the case 101 to sterilize the air supplied into the room by irradiating the ultra violet rays between the damper 170 and the outlet 140. It widely known that the ultra violet rays has a sterilizing effect, and the UV lamp 320 emitting the ultra violet rays is widely used for a purpose of sterilization, thus the construction of which will be omitted.

The ion generator 330, as illustrated in FIG. 5, is provided at the case 101. The ion generator 330 generates ion in a space between the damper 170 and the outlet 140, and the ion sterilizes the air supplied into the room. The ion generator 330 is widely used, one example of which generating ion is as follows.

For example, when high voltage is applied to a sharp needle, $O_2$ passing by the needle becomes $O_3$, i.e., a negative ion with one more $O_2$.

The $O_3$ is known for a high oxidizing power and sterilizing effect. In addition, the $O_3$ is coupled with a pollutant such as micro particle of a positive ion. When a filer for the exclusive use of ion is provided, the $O_3$ is attached to the filter so as to perform air purifying effect.

Therefore, the ion generator 330 with the abovementioned principle further includes the filter for the exclusive use of ion as illustrated in FIG. 5.

The terpene generator 340 is provided at the case 101, particularly between the filter 310 and the outlet 140 as illustrated in FIG. 6 so as to supply the terpene to the air supplied into the room. In this case, a body of the terpene generator 340 can be provided at an external of the case 101, and the nozzle 342 can be provided in the case 101.

In this case, the terpene means disinfectant being emitted by trees for protecting themselves from germs such as bacteria and worms, and a main component of phytoncide, a fragrant chemical substance having a sterilizing power.

The terpene is well known for its effects of sterilizing, stimulating secreting skin waste material and strengthening cardiopulmonary function, and resting mind and body by stimulating an autonomic nerve. Breathing in air in forest has an effect of green air bath because the air in forest has the terpene. Therefore, when the terpene is supplied into the air drawn into the room, not only the effect of sterilizing the room air but also the effect of green air bath is obtained.

Meanwhile, the air purifier 100 further includes $O_2$ generator (not shown) and an aromatic machine. In this case, the $O_2$ generator is mounted on a location same as the location of the UV lamp 320 and the ion generator 330, and also can be provided at a same location as that of the terpene generator 340.

When the $O_2$ generator is provided in the case 101, the $O_2$ generator can directly supply fresh $O_2$ to the air supplied into the room so as to improve a room environment condition.

The aromatic machine can be provided at the same location as that of the $O_2$ generator. However, it is desirable that the aromatic machine is provided at the same location as that of the terpene generator 340 as illustrated in FIG. 6.

The aromatic machine mounted as abovementioned sprays fragrance into the air supplied into the room. Then, an effect of removing bad smell generated in the room is achieved.

In the mean time, the air purifier 100 in accordance with the present invention further includes an electric heat exchanger 400. The electric heat exchanger 400 performs a role of exchanging heat between the external air and the room air flowing respectively in the supply duct 110 and the return duct 120, indirectly.

When the electric heat exchanger 400 is provided, the external air drawn from outside to the room exchanges heat with the room air discharged to the outside, and then supplied into the room. Therefore, when a hollow tube 115 and 125 are provided, the air purifier 100 in accordance with the present invention is provided in a building with a plurality of rooms. Of course, in this case, a plurality of air purifier 100 in accordance with the present invention can be provided to a building. For example, the air purifier 100 can be provided respectively at a bet room and a living room, and the hollow tube 115 and 125 can be provided at a bathroom or a kitchen.

In accordance with the present invention, the combination air purifier and the ventilator has an advantage of effectively performing the air purifying function and ventilating function in only one unit. For performing the functions, needed is only the damper provided in the case to change the passage of the air drawn into the case. Therefore, the structure is very simple.

The combination air purifier and the ventilator in accordance with the present invention includes two passages passing through the case. In other words, provided are two passages formed in a bent form, the two passages including a passage for supplying the external air into the room and a passage for discharging the room air to the outside. Therefore, the apparatus can be compact by changing the arrangement of various parts to be provided according to the air flow direction.

The combination air purifier and the ventilator can effectively remove dirt in the air floating in the room since the case is provided on a ceiling or a wall. Furthermore, there is a less possibility of trouble or being damaged since it is difficult for children to reach thereto.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An apparatus for air purifying and ventilating configured to operate in a ventilating mode and an air purifying mode, comprising:

a case provided on a ceiling or a wall and having a fan therein;

at least one air purifying member provided in the case;

a first passage passing through the case and communicating with an outside, an inside of the case, the air purifying member and a room to guide external air into the room in the ventilating mode;

a second passage passing through the case and communicating with the room, the fan, and the outside, to guide the room air to the outside in the ventilating mode;

at least one valve opening the first passage and the second passage to the outside in the ventilating mode, and cutting off the first passage and the second passage from the outside in the air purifying mode; and a damper provided in the case and configured to isolate the first passage from the second passage so as to supply the external air into the room and discharge the room air to the outside in the ventilating mode, and the damper configured to allow communication between the first passage and the second passage so as to purify the room air drawn by the fan into the air purifying member and then guided back into the room in the air purifying mode.

2. The apparatus for air purifying and ventilating of claim 1, wherein the first passage is formed in a bent form in the case such that an air flow direction of air drawn into the case and that of the air supplied into the room are different.

3. The apparatus for air purifying and ventilating of claim 1, wherein the second passage is formed in a bent form in the case such that an air flow direction of air drawn into the case and that of the air supplied into the room are different.

4. The apparatus for air purifying and ventilating of claim 1, further comprising a controller selecting one of the modes and controlling the valve and the damper in the selected mode.

5. The apparatus for air purifying and ventilating of claim 1, wherein the case comprises:

an inlet and outlet allowing communication between the case and the room; and a supply duct and a return duct allowing communication between the case and the outside.

6. The apparatus for air purifying and ventilating of claim 5, wherein the air purifying member is provided in a space between the supply duct and the return duct.

7. An apparatus for air purifying and ventilating, which is configured to operate in a ventilating mode and an air purifying mode, comprising:

a case being provided on a ceiling or a wall and having an inlet and an outlet therein;

a fan provided in the case for drawing room air;

a supply duct having a first end being coupled with the case and a second end being coupled with an outside for guiding external air into the case;

a return duct having a first end being coupled with the case and a second end being coupled with the outside to guide room air to the outside;

at least one air purifying member provided in the case for purifying the air passed through the fan or the supply duct and supplied into the room;

at least one valve opening the supply duct and the return duct in the ventilating mode, and closing the supply duct and the return duct to be blocked from the outside in the air purifying mode; and a damper provided in the case and configured to allow the inlet to communicate with the return duct, and to allow the outlet to communicate with the supply duct, and to isolate the inlet from the outlet in the ventilating mode of operation, and the damper being configured to allow the inlet to communicate with the outlet in the air purifying mode of operation.

8. The apparatus for air purifying and ventilating of claim 7, wherein the first mode and second mode respectively comprise:

an air purifying mode wherein the damper is opened, external air is drawn through the inlet, and the room air passed through the fan is guided to the outlet; and a ventilating mode wherein the damper is closed, the room air drawn through the inlet and passed through the fan is guided to the return duct, and the external air guided to the supply duct is guided to the outlet.

9. The apparatus for air purifying and ventilating of claim 7, further comprising a sensor provided at the case for measuring the room air content.

10. The apparatus for air purifying and ventilating of claim 9, wherein the damper is automatically opened and closed according to the air content measured by the sensor.

11. The apparatus for air purifying and ventilating of claim 9, wherein the sensor comprises a $CO_2$ measuring sensor.

12. The apparatus for air purifying and ventilating of claim 7, wherein the air purifying member comprises at least one of a filter, a UV lamp, a terpene generator, an $O_2$ generator, and an aromatic machine.

13. The apparatus for air purifying and ventilating of claim 7, further comprising the at least one valve provided in at least one of the supply duct or the return duct for opening and closing the supply duct and the return duct.

14. The apparatus for air purifying and ventilating of claim 7, further comprising an electric heat exchanger for exchanging heat between the supply duct and the return duct such that the air flowing in the supply duct and the return duct indirectly exchanges heat.

15. The apparatus for air purifying and ventilating of claim 7, further comprising at least one hollow tube being formed in an least one of the supply duct and the return duct and communicating with the room.

* * * * *

UNITED STATES PATENT AND TRADEMARK OFFICE

CERTIFICATE OF CORRECTION

PATENT NO. : 7,338,358 B2
APPLICATION NO. : 10/911497
DATED : March 4, 2008
INVENTOR(S) : Jeong Yong Kim et al.

It is certified that error appears in the above-identified patent and that said Letters Patent is hereby corrected as shown below:

On the Title page, in the Abstract Item (57), of the printed patent, line 5 "and an room" should be -- and a room --.

On the Title page, in the Abstract Item (57), of the printed patent, line 13 "fist" should be -- first --.

At column 12, line 12 (claim 15, line 3) of the printed patent, "in an least" should read -- in at least --.

Signed and Sealed this

Fourth Day of November, 2008

JON W. DUDAS
*Director of the United States Patent and Trademark Office*